US011317208B2

(12) United States Patent
Chau

(10) Patent No.: US 11,317,208 B2
(45) Date of Patent: Apr. 26, 2022

(54) SPEAKER SYSTEM AND SPEAKER CONFIGURATION METHOD

(71) Applicant: Tymphany Acoustic Technology Limited, Taipei (TW)

(72) Inventor: Wing Hong Chau, Taipei (TW)

(73) Assignee: TYMPHANY ACOUSTIC TECHNOLOGY LIMITED, Taipei (TW)

( * ) Notice: Subject to any disclaimer, the term of this patent is extended or adjusted under 35 U.S.C. 154(b) by 0 days.

(21) Appl. No.: 17/009,257

(22) Filed: Sep. 1, 2020

(65) Prior Publication Data

US 2021/0076137 A1 Mar. 11, 2021

Related U.S. Application Data

(60) Provisional application No. 62/898,270, filed on Sep. 10, 2019.

(51) Int. Cl.

| | |
|---|---|
| ***H04R 5/02*** | (2006.01) |
| ***H04R 5/04*** | (2006.01) |
| ***H04R 3/12*** | (2006.01) |
| ***H04S 7/00*** | (2006.01) |
| ***H04R 3/04*** | (2006.01) |

(52) U.S. Cl.

CPC ..... *H04R 5/02* (2013.01); *H04R 3/04* (2013.01); *H04R 3/12* (2013.01); *H04R 5/04* (2013.01); *H04S 7/307* (2013.01); *H04R 2430/01* (2013.01); *H04S 2400/13* (2013.01)

(58) Field of Classification Search

CPC ... H04R 5/02; H04R 5/04; H04R 3/12; H04R 3/04; H04R 2430/01; H04R 2420/00; H04R 1/26; H04R 1/24; H04R 1/02; H04R 1/026; H04R 1/20; H04R 3/00; H04R 2201/02; H04R 2201/028; H04R 2205/021; H04S 7/307; H04S 2400/13

USPC ..... 381/300, 303, 304, 308, 89, 332, 335

See application file for complete search history.

(56) References Cited

U.S. PATENT DOCUMENTS

| | | | | |
|---|---|---|---|---|
| 7,792,317 | B2 * | 9/2010 | Lin | H04R 5/02 381/388 |
| 8,165,333 | B2 * | 4/2012 | Tracy | H04R 1/26 381/335 |
| 8,369,561 | B2 * | 2/2013 | Bhutani | H04R 5/02 381/395 |
| 8,638,957 | B2 * | 1/2014 | Sim | H02J 50/40 381/182 |
| 10,111,003 | B2 * | 10/2018 | Ang | H04R 5/04 |

(Continued)

*Primary Examiner* — Xu Mei

(74) *Attorney, Agent, or Firm* — Muncy, Geissler, Olds & Lowe, P.C.

(57) ABSTRACT

This application discloses a speaker system and a speaker configuration method. The system includes: a main speaker and an expandable speaker that operate independently of each other, where the main speaker and the expandable speaker respectively play sound through respective drivers when operating independently of each other, and after the main speaker is connected to the expandable speaker, the main speaker detects and obtains parameter information of the expandable speaker for sending an audio signal to the expandable speaker according to the parameter information so that the main speaker and the expandable speaker jointly play sound, where the audio signal has a loudness information which is corresponding to the speaker system.

18 Claims, 9 Drawing Sheets

(56) References Cited

U.S. PATENT DOCUMENTS

| | | | | |
|---|---|---|---|---|
| 10,893,364 | B2 * | 1/2021 | Liniado | H04S 3/008 |
| 2015/0287419 | A1 * | 10/2015 | Chen | G06F 3/162<br>704/500 |
| 2018/0027319 | A1 * | 1/2018 | Yang | H04R 1/1075<br>381/375 |
| 2019/0222934 | A1 * | 7/2019 | Liniado | H04R 5/02 |

* cited by examiner

SPEAKER SYSTEM AND SPEAKER CONFIGURATION METHOD

CROSS REFERENCE TO RELATED APPLICATIONS

The present application claims priority to U.S. Provisional Patent Application No. 62/898,270, which was filed on Sep. 10, 2019, the entire contents of which are hereby incorporated by reference.

BACKGROUND OF THE INVENTION

Technical Field

This application relates to a speaker system and a speaker configuration method.

Related Art

Bluetooth speakers are widely welcomed by people as a personal music device. There are many different sizes of Bluetooth speakers on the market, so different need of users for music play loudness in different occasions (such as an outdoor place, a restaurant, a kitchen, or a bathroom, etc.) can be met. A key factor in speaker loudness is the volume of the air inside the speaker and the diameter of the speaker driver; and another key factor is the function of the audio amplifier and the provided current. Main circuit board components and core configurations of all these different sizes wireless speakers (including a Bluetooth speaker) are very similar or almost the same. These wireless speakers all have similar Bluetooth ICs, signal processing ICs, amplifier ICs, and microcontroller units (MCU).

Different speakers used in different occasions for general families are not necessary. Because each device can be used only in some environments, it greatly reduces the use frequency of each speaker device. In addition, when a user expects to have different loudness, it needs to connect with different speaker devices. Accordingly, the user needs to switch for different connections.

SUMMARY

In order to solve the above problems in the prior arts, the present application provides a speaker system that can be expanded for hardware devices and can be connected to different sizes speakers, so as to provide different loudness.

The technical solutions of this application are implemented as follows.

According to an aspect of this application, a speaker system is provided, including a main speaker and an expandable speaker that operate independently of each other, where the main speaker and the expandable speaker respectively play sound through respective drivers when operating independently of each other, and when the main speaker is connected to the expandable speaker, the main speaker detects and obtains parameter information of the expandable speaker for sending an audio signal to the expandable speaker according to the parameter information so that the main speaker and the expandable speaker jointly play sound, wherein the audio signal has a loudness information which is corresponding to the speaker system.

According to the embodiment of this application, the parameter information includes at least one of the following: a driver type of the expandable speaker, a quantity of drivers of the expandable speaker, a size of an acoustic space inside a sound box of the expandable speaker, a current required by the expandable speaker, a driver diameter of the expandable speaker, and audio amplifier performance required by the expandable speaker.

According to the embodiment of this application, the main speaker is further configured to send at least one of the following to the expandable speaker: a first signal generated in response to a voice control instruction, and a second signal generated in response to a gesture control instruction, where the expandable speaker performs an operation corresponding to the first signal or the second signal.

According to the embodiment of this application, the main speaker includes: a microcontroller configured to detect the parameter information of the expandable speaker; and an audio processing unit, where the microcontroller controls the audio processing unit to adjust the audio signal based on the parameter information.

According to the embodiment of this application, the main speaker further includes: an amplifier configured to amplify an adjusted audio signal to attain the loudness.

According to the embodiment of this application, the expandable speaker further includes: a power supply unit configured to supply power to the main speaker or the expandable speaker.

According to the embodiment of this application, the main speaker includes a first connection interface, and the expandable speaker includes a second connection interface, wherein the main speaker is detachably communicatively connected to the expandable speaker through the first connection interface and the second connection interface.

According to another aspect of this application, a speaker system is provided, including a main speaker and an expandable speaker that operate independently of each other, where the main speaker and the expandable speaker respectively play sound through respective drivers when operating independently of each other. The main speaker includes a first connection interface, and the expandable speaker includes a second connection interface, wherein the main speaker is detachably communicatively connected to the expandable speaker through the first connection interface and the second connection interface and when the main speaker is communicatively connected to the expandable speaker, the main speaker detects and obtains parameter information of the expandable speaker, and the main speaker and the expandable speaker jointly play sound with loudness corresponding to the speaker system based on the parameter information.

According to the embodiment of this application, the parameter information includes at least one of the following: a driver type of the expandable speaker, a quantity of drivers of the expandable speaker, a size of an acoustic space inside a sound box of the expandable speaker, a current required by the expandable speaker, a driver diameter of the expandable speaker, and audio amplifier performance required by the expandable speaker.

According to the embodiment of this application, the main speaker further includes: a microcontroller connected to the first connection interface, where the first connection interface has a detection pin, and the microcontroller obtains the parameter information of the expandable speaker through the detection pin; and an audio processing unit connected to the microcontroller and the first connection interface, the microcontroller sending a control signal to the audio processing unit according to the parameter information, and the audio processing unit generating an audio signal corresponding to the speaker system in response to the control signal to enable a driver of the expandable speaker to play sound.

According to the embodiment of this application, the main speaker further includes: an amplifier connected to the audio processing unit and the first connection interface, the amplifier amplifying the audio signal and sending an amplified audio signal to the expandable speaker through the first connection interface and the second connection interface.

According to the embodiment of this application, the expandable speaker includes: a power supply unit connected to the second connection interface, the power supply unit supplying power to the main speaker through the second connection interface.

According to the embodiment of this application, a surface of one of the main speaker and the expandable speaker has a recess, the recess being configured to accommodate the other of the main speaker and the expandable speaker so that the main speaker is communicatively connected to the expandable speaker.

According to the embodiment of this application, the main speaker includes a first locking structure, and the expandable speaker includes a second locking structure, where one of the first locking structure and the second locking structure includes a magnetic component, and the other of the first locking structure and the second locking structure includes a metal component corresponding to the magnetic component.

According to another aspect of this application, a speaker system configuration method is provided, the speaker system including a main speaker and an expandable speaker that operate independently of each other, where the main speaker and the expandable speaker respectively play sound through respective drivers when operating independently of each other, and the method includes connecting the main speaker to the expandable speaker; obtaining and detecting parameter information of the expandable speaker and transmitting the parameter information to the main speaker; sending an audio signal to the expandable speaker according to the parameter information; and jointly playing sound by the main speaker and the expandable speaker, where the audio signal has a loudness information which is corresponding to a speaker system.

According to the embodiment of this application, the parameter information includes at least one of the following: a driver type of the expandable speaker, a quantity of drivers of the expandable speaker, a size of an acoustic space inside a sound box of the expandable speaker, a current required by the expandable speaker, a driver diameter of the expandable speaker, and audio amplifier performance required by the expandable speaker.

According to the embodiment of this application, the main speaker sends a control signal to the expandable speaker to enable the expandable speaker to perform a corresponding operation, where the control signal includes at least one of a first signal generated in response to a voice control instruction and a second signal generated in response to a gesture control instruction.

According to the embodiment of this application, the step of obtaining and detecting parameter information of the expandable speaker and transmitting the parameter information to the main speaker further includes detecting the parameter information of the expandable speaker through a microcontroller of the main speaker; and controlling an audio processing unit of the main speaker to adjust the audio signal based on the parameter information.

According to this embodiment of the application, the step of jointly playing sound by the main speaker and the expandable speaker further includes amplifying an adjusted audio signal through an amplifier of the main speaker to send an amplified audio signal to the expandable speaker.

According to the embodiment of this application, the step of connecting the main speaker to the expandable speaker further includes supplying power to the main speaker or the expandable speaker through a power supply unit of the expandable speaker.

BRIEF DESCRIPTION OF THE DRAWINGS

In order to explain the embodiments of the present application more clearly, the following will briefly describe the drawings in the embodiments. It is obvious that the drawings in the following description are only some embodiments of the present application, for those skilled in the art, other drawings may be obtained from these drawings without creative work.

DETAILED DESCRIPTION

The following clearly and completely describes the technical solutions in the embodiments of this application with reference to the accompanying drawings in the embodiments of this application. Apparently, the described embodiments are merely some embodiments of this application rather than all of the embodiments. All other embodiments obtained by a person of ordinary skill in the art based on the embodiments of this application shall fall within the protection scope of this application.

Figure 1:
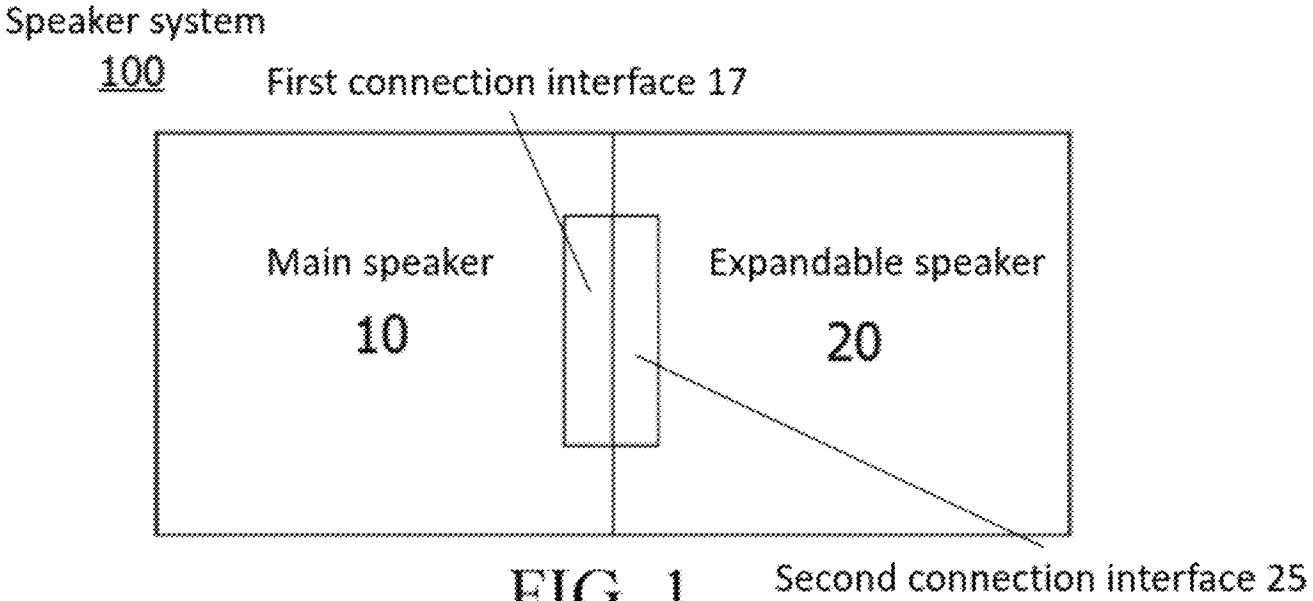
FIG. 1 is a block diagram of a speaker system according to an embodiment of this application.

FIG. 1 is a block diagram of a speaker system 100 according to an embodiment of this application. The speaker system 100 includes a main speaker 10 and an expandable speaker 20 that can operate independently of each other. The main speaker 10 plays sound through a main speaker driver when operating independently. The expandable speaker 20 plays sound through an expandable speaker driver when operating independently.

The main speaker 10 may have a first connection interface 17, and the expandable speaker 20 may have a second connection interface 25. The main speaker 10 can be detachably and communicatively connected to the expandable speaker 20 through the first connection interface 17 and the second connection interface 25. The first connection interface 17 may have a communication bus to communicate bidirectionally with the expandable speaker 20. The first connection interface 17 may be an interface connected to any kind of expandable speaker 20.

When the main speaker 10 is connected to the expandable speaker 20, the main speaker 10 detects and obtains parameter information of the expandable speaker 20, and an audio signal of the main speaker 10 is sent to the expandable speaker 20 based on the parameter information so that the main speaker 10 and the expandable speaker 20 jointly play sound, wherein the audio signal has a content information and a loudness information. The content information is used to represent the playback content, for example, music. The loudness information is used to set the loudness of the output sound and is corresponding to the speaker system. When the main speaker 10, the expandable speaker 20 or the combination of main speaker 10 and expandable speaker 20 receive the audio signal, a sound will be played according to the content information of the audio signal and set the loudness of the sound according to the loudness information of the audio signal. Therefore, according to the speaker system provided in this application, the main speaker 10 can be expanded and can be connected to speakers of different sizes, thereby providing different loudness.

Figure 2:
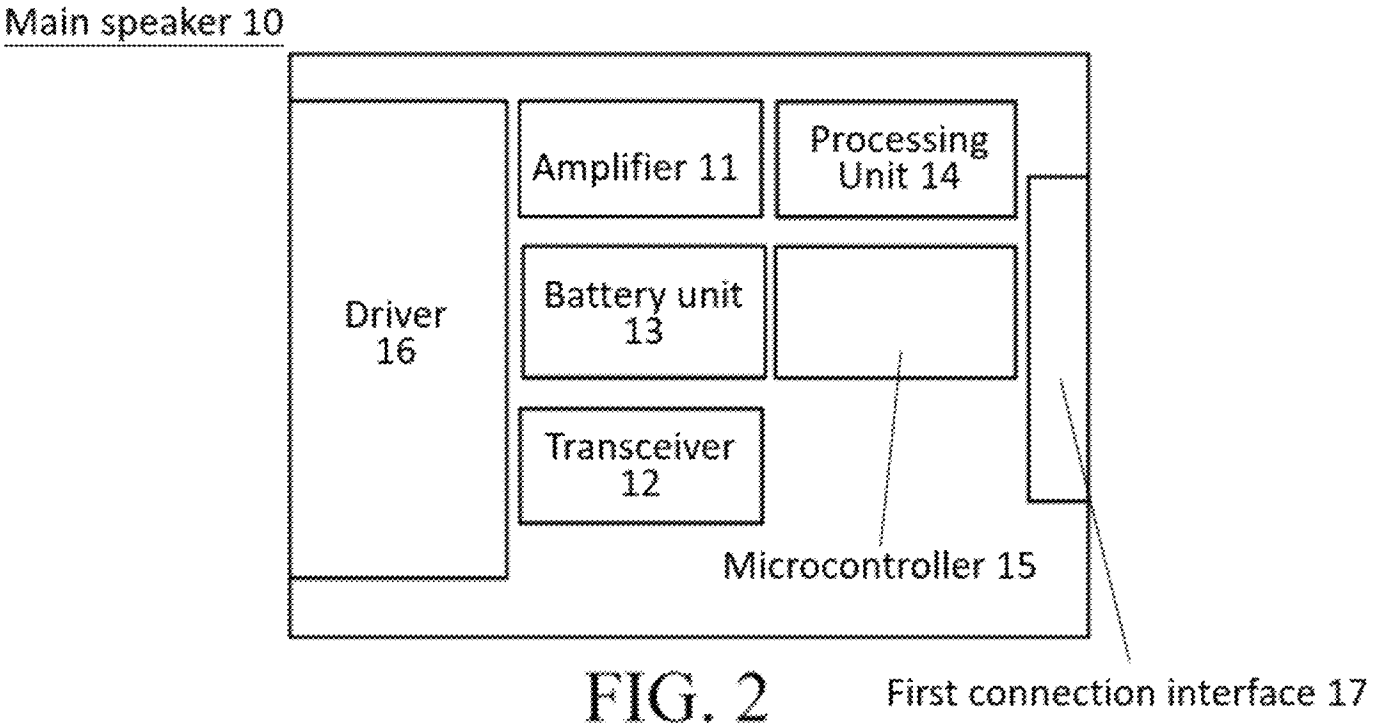
FIG. 2 is a block diagram of a main speaker according to an embodiment of this application.

FIG. 2 is a block diagram of the main speaker 10 according to an embodiment of this application. The main speaker 10 may be various sizes and types of speakers. A driver 16 of the main speaker 10 may include any one or any combination of a woofer driver, a tweeter driver, and a full range driver.

As shown in FIG. 2, the main speaker 10 may include an amplifier 11, and the amplifier 11 may be connected to an audio processing unit 14 and the first connection interface 17. The amplifier 11 is an audio amplifier for providing an electric signal for a driver of a speaker. The amplifier 11 may be a mono amplifier. The amplifier may also be a multi-channel amplifier including various amplifier components. The amplifier 11 may amplify an audio signal and route an amplified audio signal to the first connection interface 17 of the main speaker 10 to further provide the amplified audio signal for the expandable speaker 20.

The main speaker 10 may further include a wireless transceiver 12, and the wireless transceiver 12 allows the main speaker 10 to receive sound signals from other devices or send sound signals to other devices. The wireless transceiver 12 may adopt Bluetooth, Wi-Fi, and any other wireless protocols. The wireless transceiver 12 may communicate with other devices in the main speaker 10 to perform different functions for playing music (for example, playing Bluetooth music, playing Wi-Fi music, function of playing, and function of pausing).

The main speaker 10 may be a battery-powered, DC-powered or AC-powered speaker, and the main speaker 10 may further include a battery unit 13. The battery unit 13 includes at least a battery, and the battery unit 13 may provide power for the main speaker 10 to play music. Specifically, the battery unit 13 may have a DC/AC conversion circuit to provide a DC current for the main speaker 10. The battery unit 13 may also have a battery charger, and the battery charger may charge the battery of the battery unit 13 after being connected to AC or DC power.

The main speaker 10 may further include the audio processing unit 14, and the audio processing unit 14 may be connected to a microcontroller 15 and the first connection interface 17. In one embodiment, the audio processing unit 14 may be a digital signal processor (DSP). The audio processing unit 14 may receive an audio signal, and process and adjust the audio signal so that the audio signal has an optimal frequency response for the main speaker 10. When the main speaker 10 is connected to the expandable speaker 20, the audio processing unit 14 adjusts the loudness information of the audio signal to properly play music of the combination of the main speaker 10 and the expandable speaker 20.

The main speaker 10 may further include a microcontroller 15, and the microcontroller 15 is connected to the first connection interface 17. The microcontroller 15 is a main control component of the main speaker 10, and may control various peripheral devices and sub-circuits of the main speaker 10. The microcontroller 15 may detect the second connection interface 25 of the expandable speaker 20 and control the audio processing unit 14 to adopt a new audio processing algorithm to fit the speaker system and produce the best acoustic performance.

The first connection interface 17 may have a detection pin, and the microcontroller 15 obtains parameter information of the expandable speaker 20 through the detection pin. In one embodiment, the parameter information may include at least one of the following: a driver type of the expandable speaker 20, a quantity of drivers of the expandable speaker 20, a size of an acoustic space inside a sound box of the expandable speaker 20, a current required by the expandable speaker 20, a driver diameter of the expandable speaker 20, and audio amplifier performance required by the expandable speaker 20. Accordingly, the microcontroller 15 may detect a type, a quantity, a size, and the like of the expandable speaker 20 through the detection pin. Therefore, the microcontroller 15 may send a control signal to the audio processing unit 14 according to the parameter information, and the audio processing unit 14 adjusts the audio signal in response to the control signal so as to generate an audio signal corresponding to the speaker system. The first connection interface 17 may transmit the amplified audio signal, for example, higher than 1 Vrms, to the driver of the expandable speaker 20. The first connection interface 17 may have one or more audio channels to send the audio signal to the expandable speaker 20.

Figure 3:
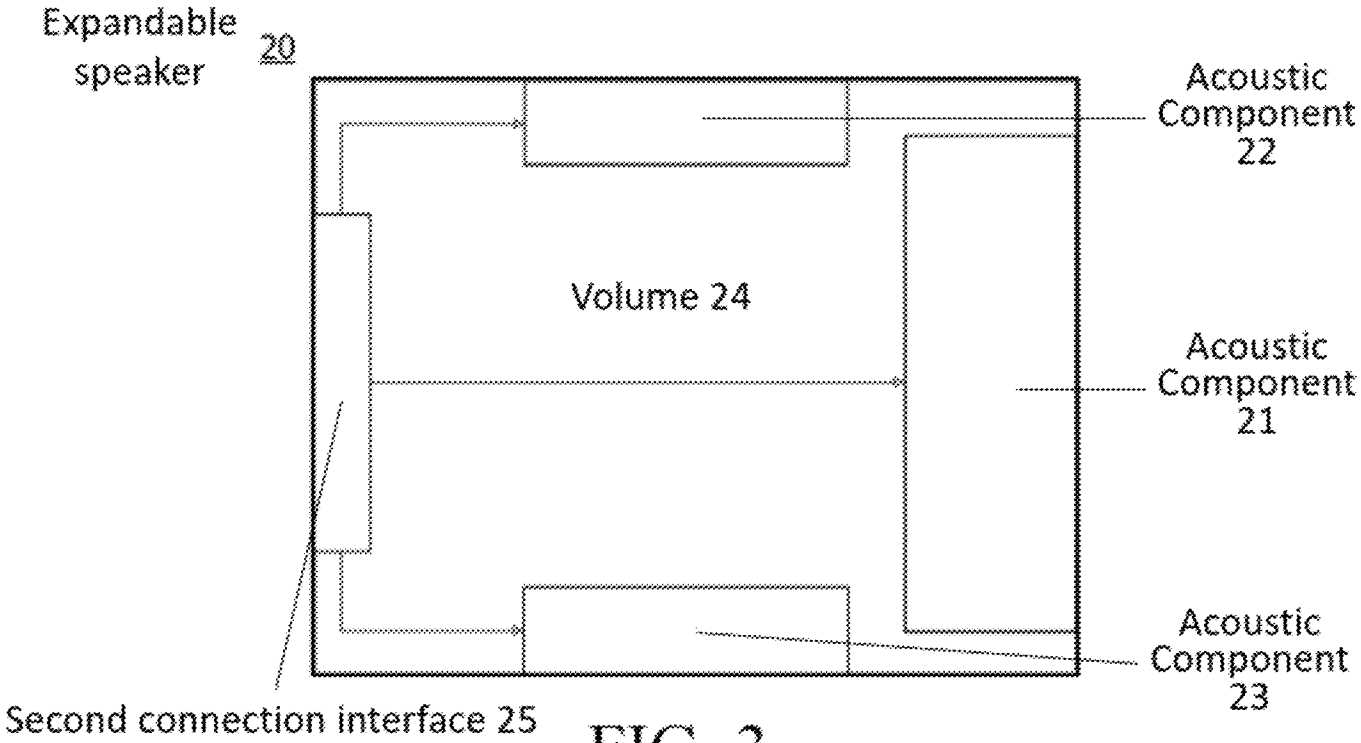
FIG. 3 is a block diagram of an expandable speaker according to an embodiment of this application.

FIG. 3 is a block diagram of the expandable speaker 20 according to an embodiment of this application. The expandable speaker 20 may be configured to provide the main speaker 10 for properly loudness or other additional functions. In one embodiment, the main speaker 10 may be further configured to send a first signal generated in response to a voice control instruction and/or a second signal generated in response to a gesture control instruction to the expandable speaker 20. The expandable speaker 20 performs an operation corresponding to the first signal or the second signal. Therefore, the expandable speaker 20 may be configured to provide the additional functions (for example, a voice control and/or a gesture sensing control) for the main speaker 10.

The expandable speaker 20 may include acoustic components 21, 22, and 23. The acoustic components 21, 22, and 23 may include various drivers, such as any one or a combination of a woofer driver, a tweeter driver, and a full range driver.

As shown in FIG. 3, a volume 24 may indicate an internal volume of the expandable speaker 20. According to a cabinet size of the expandable speaker 20, the internal volume is fitted to match acoustic components of different sizes.

Figure 4:
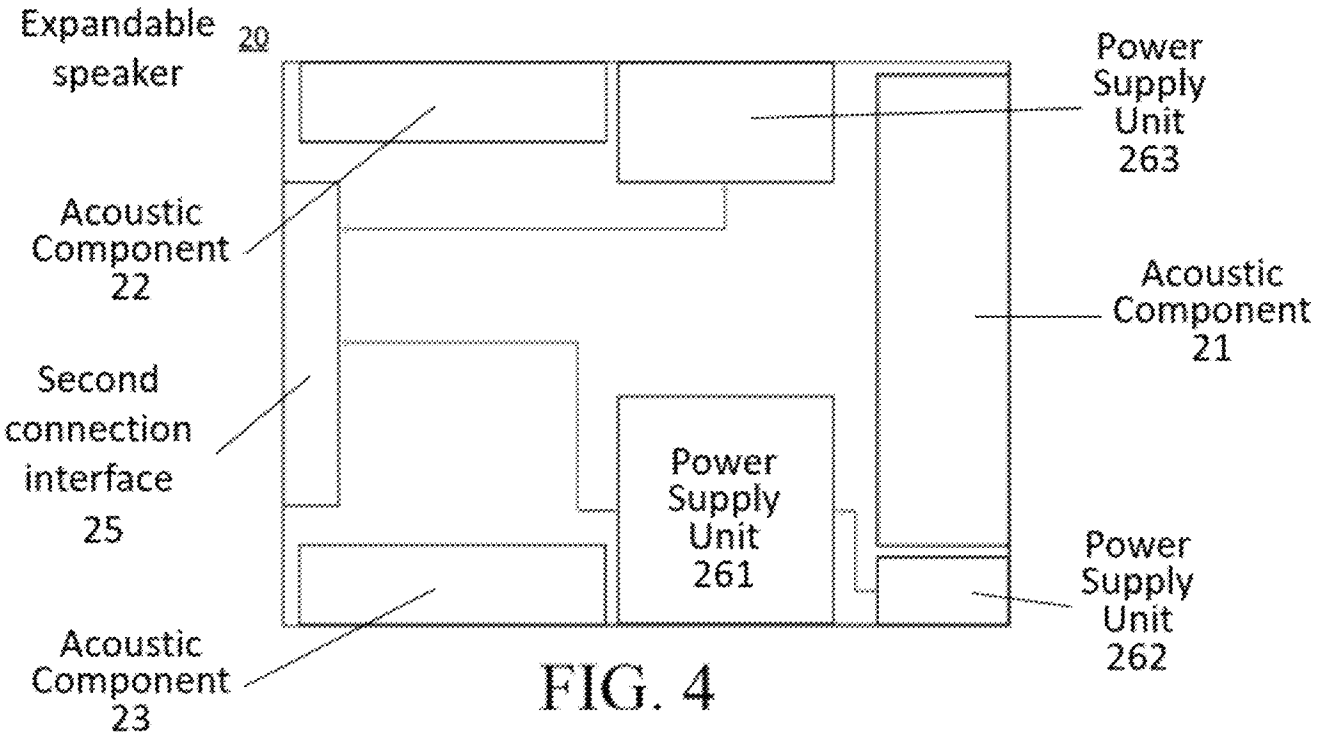
FIG. 4 is a block diagram of an expandable speaker according to an embodiment of this application.

FIG. 4 is a block diagram of the expandable speaker 20 according to another embodiment of this application. In this embodiment, the expandable speaker 20 may further include power supply units 261, 262, 263, and the power supply units 261, 262, 263 are connected to the second connection interface 25. In one embodiment, the power supply unit 262 may be an AC unit, and the power supply unit 261 may be an AC/DC conversion unit. The power supply units 261, 262, and 263 supply power to the main speaker 10 through the second connection interface 25. The power supply units 261, 262, and 263 may be configured to provide additional power supply currents to the amplifier or other circuits of the main speaker 10, so that the main speaker 10 generates required loudness.

Figure 5:
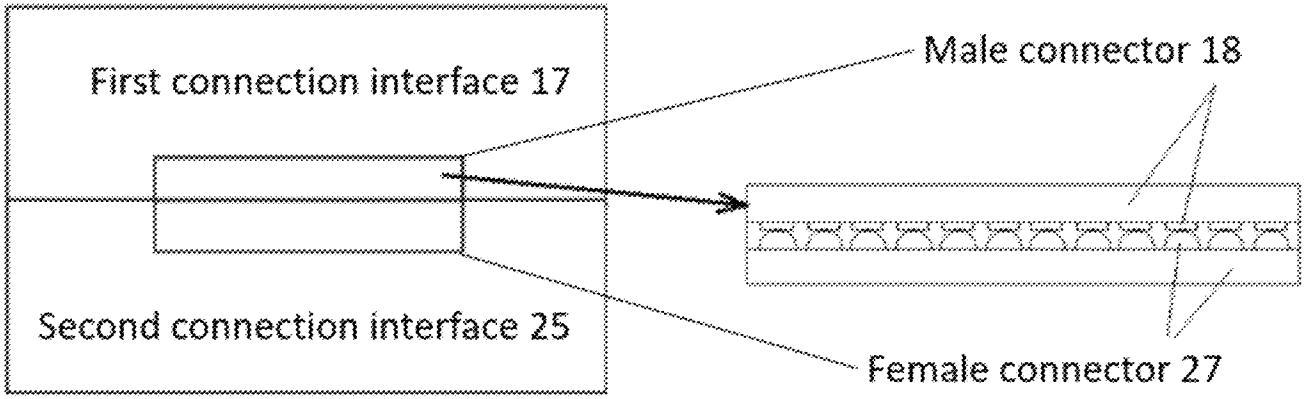
FIG. 5 is a schematic diagram of a first connection interface and a second connection interface according to an embodiment of this application.

FIG. 5 is a schematic diagram of the first connection interface 17 and the second connection interface 25 according to an embodiment of this application. In this embodiment, the first connection interface 17 and the second connection interface 25 may have a male connector 18 and a female connector 27, respectively. The quantity of pins of the male connector 18 and the female connector 27 may change according to the quantity of required signals. In other embodiments, the first connection interface 17 and the second connection interface 25 may also adopt other appropriate connection components.

Figure 6:
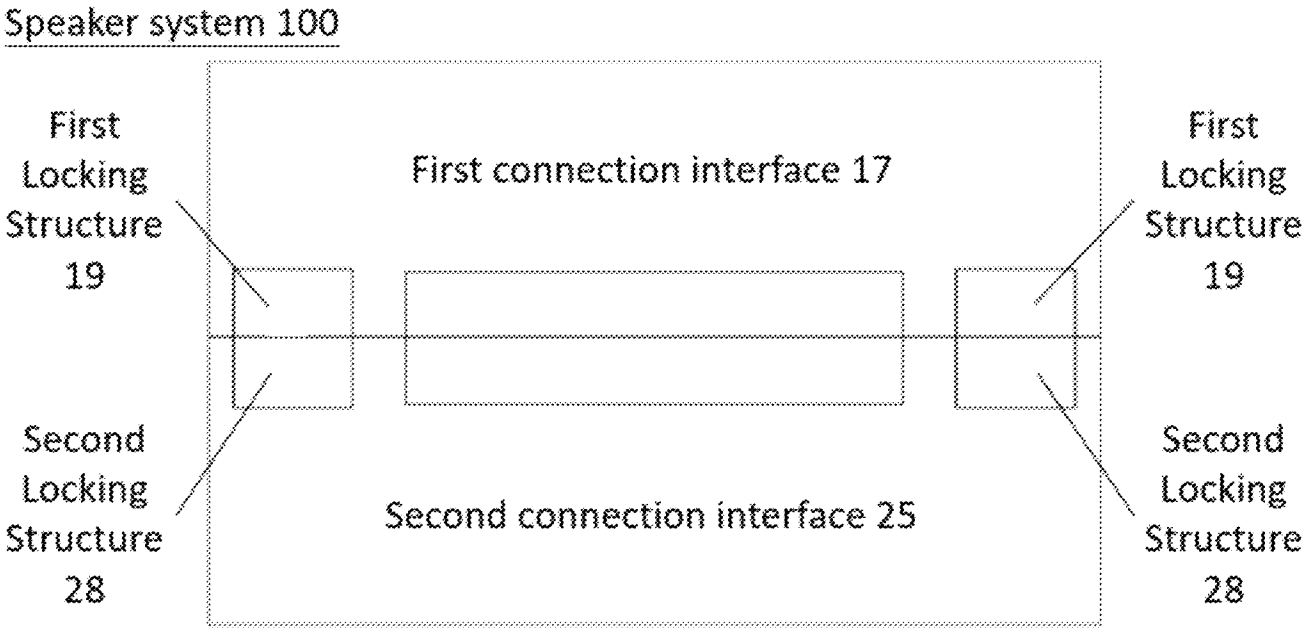
FIG. 6 is a schematic diagram of a speaker system according to an embodiment of this application.

FIG. 6 is a schematic diagram of a speaker system according to an embodiment of this application. The main speaker 10 may include a first locking structure 19 and the expandable speaker 20 may include a second locking structure 28. In one embodiment, one of the first locking structure 19 and the second locking structure 28 includes a magnetic component, and the other one includes a metal component. Therefore, it can be ensured that the main speaker 10 and the expandable speaker 20 are firmly connected. In other embodiments, any other suitable locking structure may also be used.

Figure 7:
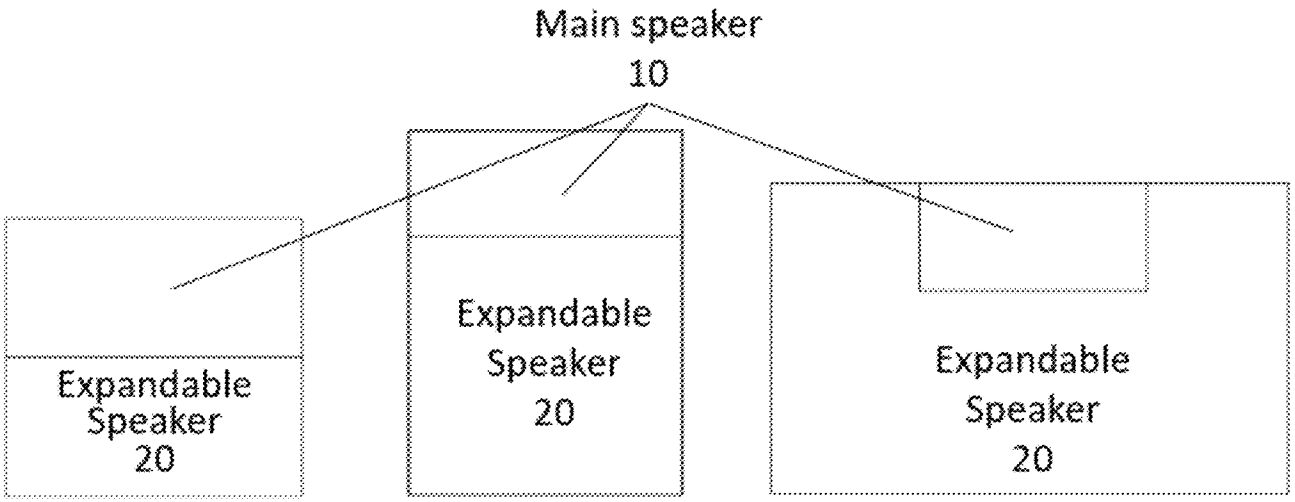
FIG. 7 is a schematic diagram of a plurality of speaker systems according to an embodiment of this application.
Figure 8:
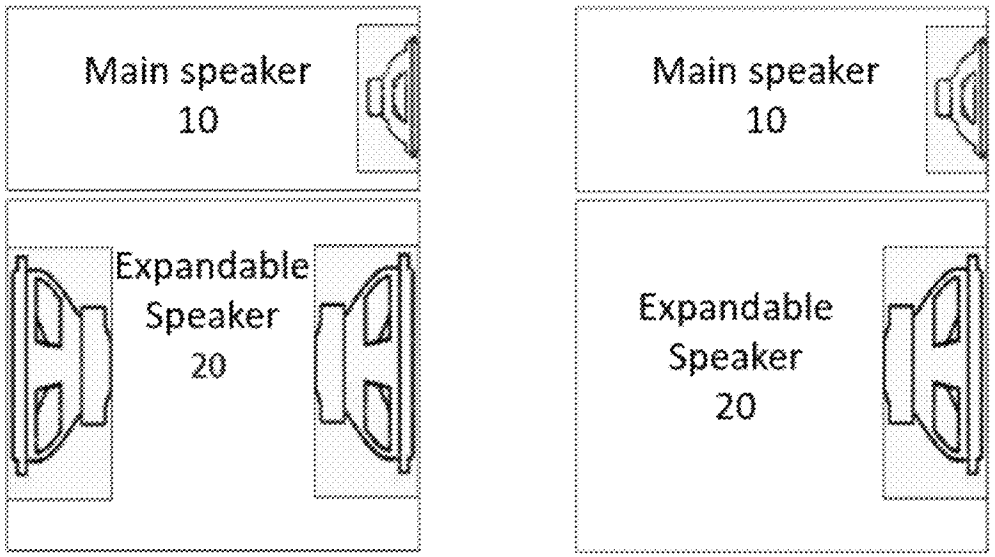
FIG. 8 is a schematic diagram of a plurality of speaker systems according to an embodiment of this application.

FIG. 7 is a schematic diagram of a plurality of speaker systems according to an embodiment of this application. FIG. 8 is a schematic diagram of a plurality of speaker systems according to an embodiment of this application. In one embodiment, the main speaker 10 and the expandable speaker 20 may have the same size. In one embodiment, the main speaker 10 and the expandable speaker 20 may have different sizes. In one embodiment, the main speaker 10 and the expandable speaker 20 may be connected in opposite planes. In another embodiment, a surface of one of the main speaker 10 and the expandable speaker 20 has a recess, the recess being configured to accommodate the other one so that the main speaker 10 is communicatively connected to the expandable speaker 20. As shown in FIG. 8, in one embodiment, the main speaker 10 and the expandable speaker 20 may have the same quantity of drivers. In one embodiment, the main speaker 10 and the expandable speaker 20 may have different quantities of drivers. In one embodiment, the main speaker 10 and the expandable speaker 20 may have different sizes of speakers.

Figure 9:
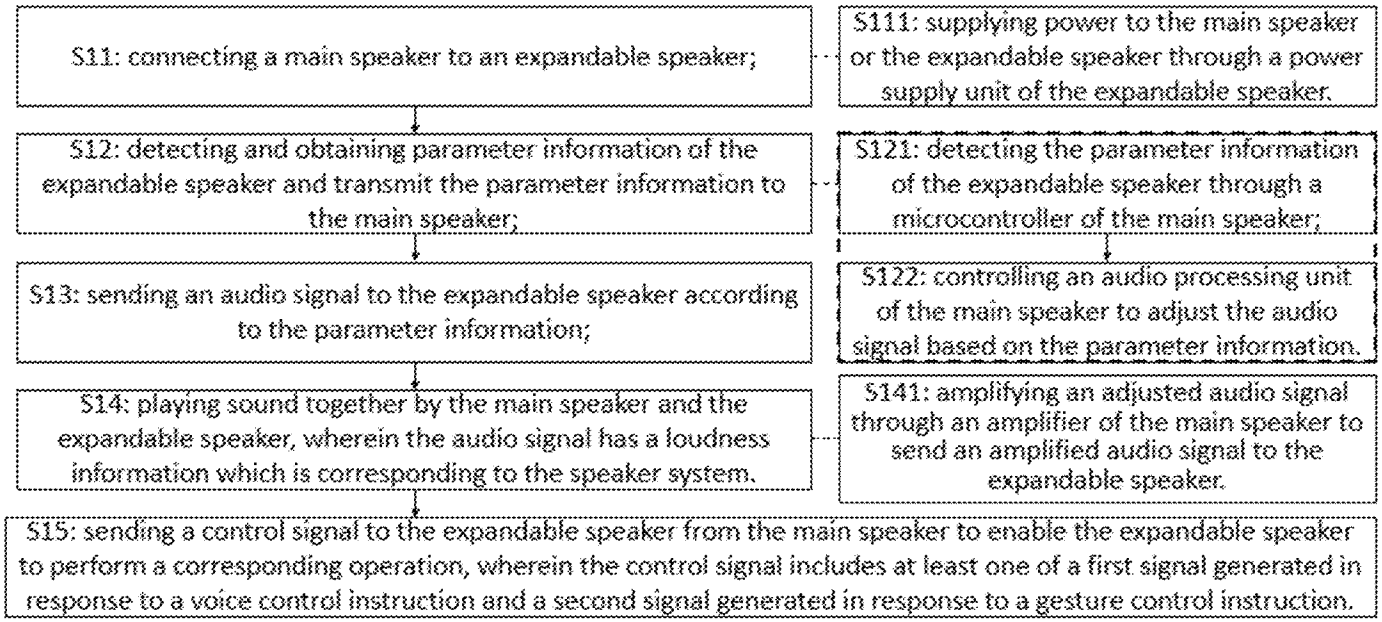
FIG. 9 is a schematic flowchart of a speaker configuration method according to an embodiment of this application.

FIG. 9 is a schematic flowchart of a speaker configuration method according to an embodiment of this application. The speaker configuration method in the embodiment of this application includes the following steps:

Step S11: connecting a main speaker to an expandable speaker;

Step S12: detecting and obtaining parameter information of the expandable speaker and transmit the parameter information to the main speaker;

Step S13: sending an audio signal to the expandable speaker according to the parameter information; and Step S14: playing sound together by the main speaker and the expandable speaker, wherein the audio signal has a loudness information which is corresponding to the speaker system.

The parameter information includes at least one of the following: a driver type of the expandable speaker, a quantity of drivers of the expandable speaker, a size of an acoustic space inside a sound box of the expandable speaker, a current required by the expandable speaker, a driver diameter of the expandable speaker, and audio amplifier performance required by the expandable speaker.

The speaker configuration method in the embodiment of this application further includes: step S15: sending a control signal to the expandable speaker from the main speaker to enable the expandable speaker to perform a corresponding operation, wherein the control signal includes at least one of a first signal generated in response to a voice control instruction and a second signal generated in response to a gesture control instruction.

Step S12 further includes: step S121: detecting the parameter information of the expandable speaker through a microcontroller of the main speaker; and step S122: controlling an audio processing unit of the main speaker to adjust the audio signal based on the parameter information.

Step S14 further includes: step S141: amplifying an adjusted audio signal through an amplifier of the main speaker to send an amplified audio signal to the expandable speaker.

Step S11 further includes: step S111: supplying power to the main speaker or the expandable speaker through a power supply unit of the expandable speaker.

The foregoing descriptions are merely exemplary embodiments of this application, but are not intended to limit this application. Any modification, equivalent replacement, or improvement made without departing from the spirit and principle of this application shall fall within the protection scope of this application.

What is claimed is:

1. A speaker system comprising:

an expandable speaker; and a main speaker connected to the expandable speaker, the main speaker configured to detect and obtain parameter information of the expandable speaker for sending an audio signal to the expandable speaker according to the parameter information so that the main speaker and the expandable speaker jointly play sound, wherein the expandable speaker and the main speaker operate independently of each other, wherein the main speaker and the expandable speaker respectively play sound through respective drivers when operating independently of each other, wherein the audio signal has a loudness information corresponding to the speaker system, and wherein the parameter information comprises at least one of the following: a driver type of the expandable speaker, a quantity of drivers of the expandable speaker, a size of an acoustic space inside a sound box of the expandable speaker, a current required by the expandable speaker, a driver diameter of the expandable speaker, and audio amplifier performance required by the expandable speaker.

2. The speaker system according to claim 1, wherein the main speaker is further configured to send at least one of the following: a first signal generated in response to a voice control instruction, and a second signal generated in response to a gesture control instruction, to the expandable speaker, and wherein the expandable speaker is configured to perform an operation corresponding to the first signal or the second signal.

3. The speaker system according to claim 1, wherein the main speaker comprises:

a microcontroller configured to detect the parameter information of the expandable speaker; and an audio processing unit, wherein the microcontroller controls the audio processing unit to adjust the audio signal based on the parameter information.

4. The speaker system according to claim 3, wherein the main speaker further comprises:

an amplifier configured to amplify an adjusted audio signal to attain the loudness.

5. The speaker system according to claim 1, wherein the expandable speaker further comprises:

a power supply unit configured to supply power to the main speaker or the expandable speaker.

6. The speaker system according to claim 1, wherein the main speaker comprises a first connection interface, wherein the expandable speaker comprises a second connection interface, and wherein the main speaker is detachably communicatively connected to the expandable speaker through the first connection interface and the second connection interface.

7. A speaker system, comprising:

an expandable speaker comprising a second connection interface; and a main speaker comprising a first connection interface, wherein the expandable speaker and the main speaker operate independently of each other, wherein the main speaker and the expandable speaker respectively play sound through respective drivers when operating independently of each other, wherein the main speaker is detachably communicatively connected to the expandable speaker through the first connection interface and the second connection interface, wherein, when the main speaker is communicatively connected to the expandable speaker, the main speaker is configured to detect and obtain parameter information of the expandable speaker, and the main speaker and the expandable speaker jointly play, according to the parameter information, sound with loudness corresponding to the speaker system, and wherein the parameter information comprises at least one of the following: a driver type of the expandable speaker, a quantity of drivers of the expandable speaker, a size of an acoustic space inside a sound box of the expandable speaker, a current required by the expandable speaker, a driver diameter of the expandable speaker, and audio amplifier performance required by the expandable speaker.

8. The speaker system according to claim 7, wherein the parameter information comprises at least one of the following: a driver type of the expandable speaker, a quantity of drivers of the expandable speaker, a size of an acoustic space inside a sound box of the expandable speaker, a current required by the expandable speaker, a driver diameter of the expandable speaker, and audio amplifier performance required by the expandable speaker.

9. The speaker system according to claim 7, wherein the main speaker further comprises:

a microcontroller connected to the first connection interface, the first connection interface having a detection pin, and the microcontroller is configured to obtain the parameter information of the expandable speaker through the detection pin; and an audio processing unit connected to the microcontroller and the first connection interface, wherein the microcontroller is configured to send a control signal to the audio processing unit according to the parameter information, and the audio processing unit is configured to generate an audio signal corresponding to the speaker system in response to the control signal to enable a driver of the expandable speaker to play sound.

10. The speaker system according to claim 9, wherein the main speaker further comprises:

an amplifier connected to the audio processing unit and the first connection interface, wherein the amplifier is configured to amplify the audio signal and send an amplified audio signal to the expandable speaker through the first connection interface and the second connection interface.

11. The speaker system according to claim 7, wherein the expandable speaker comprises:

a power supply unit connected to the second connection interface, the power supply unit supplying power to the main speaker through the second connection interface.

12. The speaker system according to claim 7, wherein a surface of one of the main speaker and the expandable speaker has a recess, the recess being configured to accommodate the other of the main speaker and the expandable speaker so that the main speaker is communicatively connected to the expandable speaker.

13. The speaker system according to claim 7, wherein the main speaker comprises a first locking structure, and the expandable speaker comprises a second locking structure, and wherein one of the first locking structure and the second locking structure comprises a magnetic component, and the other of the first locking structure and the second locking structure comprises a metal component corresponding to the magnetic component.

14. A speaker system configuration method, the speaker system comprising a main speaker and an expandable speaker that operate independently of each other, wherein the main speaker and the expandable speaker respectively play sound through respective drivers when operating independently of each other, the method comprising:

connecting the main speaker to the expandable speaker;

detecting and obtaining parameter information of the expandable speaker and transmitting the parameter information to the main speaker;

sending an audio signal to the expandable speaker according to the parameter information; and jointly playing sound by the main speaker and the expandable speaker, wherein the audio signal has a loudness information which is corresponding to a speaker system, wherein the parameter information comprises at least one of the following: a driver type of the expandable speaker, a quantity of drivers of the expandable speaker, a size of an acoustic space inside a sound box of the expandable speaker, a current required by the expandable speaker, a driver diameter of the expandable speaker, and audio amplifier performance required by the expandable speaker.

15. The speaker system configuration method according to claim 14, further comprising: sending a control signal to the expandable speaker from the main speaker to enable the expandable speaker to perform a corresponding operation, wherein the control signal comprises at least one of a first signal generated in response to a voice control instruction and a second signal generated in response to a gesture control instruction.

16. The speaker system configuration method according to claim 14, wherein said detecting and obtaining parameter information of the expandable speaker and transmitting the parameter information to the main speaker further comprises:

detecting the parameter information of the expandable speaker through a microcontroller of the main speaker; and controlling an audio processing unit of the main speaker to adjust the audio signal based on the parameter information.

17. The speaker system configuration method according to claim 14, wherein said jointly playing sound by the main speaker and the expandable speaker further comprises:

amplifying an adjusted audio signal through an amplifier of the main speaker to send an amplified audio signal to the expandable speaker.

18. The speaker system configuration method according to claim 14, wherein said connecting the main speaker to the expandable speaker further comprises:

supplying power to the main speaker or the expandable speaker through a power supply unit of the expandable speaker.

* * * * *